US012246898B2

(12) United States Patent
Konukoglu et al.

(10) Patent No.: US 12,246,898 B2
(45) Date of Patent: Mar. 11, 2025

(54) TRANSPORT UNIT FOR COILS, AND ARRANGEMENT COMPRISING THE TRANSPORT UNITS

(71) Applicant: SANKO TEKSTIL ISLETMELERI SANAYI VE TICARET ANONIM SIRKETI, Gaziantep (TR)

(72) Inventors: Hakan Konukoglu, Gaziantep (TR); Goekhan Aydin, Gaziantep (TR)

(73) Assignee: SANKO TEKSTIL ISLETMELERI SANAYI VE TICARET ANONIM SIRKETI, Gaziantep (TR)

( * ) Notice: Subject to any disclaimer, the term of this patent is extended or adjusted under 35 U.S.C. 154(b) by 169 days.

(21) Appl. No.: 17/904,588

(22) PCT Filed: Feb. 21, 2020

(86) PCT No.: PCT/EP2020/054686
§ 371 (c)(1),
(2) Date: Aug. 18, 2022

(87) PCT Pub. No.: WO2021/164889
PCT Pub. Date: Feb. 26, 2021

(65) Prior Publication Data

US 2023/0093455 A1 Mar. 23, 2023

(51) Int. Cl.
*B65D 71/00* (2006.01)
*B65D 19/00* (2006.01)
(Continued)

(52) U.S. Cl.
CPC ..... *B65D 71/0096* (2013.01); *B65D 19/004* (2013.01); *B65D 33/1616* (2013.01);
(Continued)

(58) Field of Classification Search
CPC ..... B65D 33/1616; B65D 19/004; B65D 71/0096
(Continued)

(56) References Cited

U.S. PATENT DOCUMENTS 2,349,206 A * 5/1944 Stohlman ..... B65D 29/00 383/7
2,444,326 A * 6/1948 Baker ..... B65D 19/0026 108/55.3
(Continued)

FOREIGN PATENT DOCUMENTS

DE 7723483 U1 11/1977
DE 3509109 A1 9/1986
(Continued)

OTHER PUBLICATIONS

ISA European Patent Office, International Search Report Issued in Application No. PCT/EP2020/054686, October 203, 2020, WIPO, 3 pages.

*Primary Examiner* — Steven A. Reynolds
*Assistant Examiner* — Prince Pal
(74) *Attorney, Agent, or Firm* — McCoy Russell LLP

(57) ABSTRACT

The disclosure relates to a transportation unit for transporting a plurality of coils. This transportation unit provides an easy transportation and an easy to handle system wherein the respective load of coils which can be shipped can be increased. The transportation unit comprises a palette, and a plurality of bags stacked in layers on the palette, wherein each of the bags contains a plurality of coils arranged in a first layer such that centers of the coils in the first layer are arranged parallel with respect to each other such that an axial direction of the center of each coil in the first layer is approximately perpendicular to an extension direction of the
(Continued)

palette. Further the disclosure relates to an assembly comprising a plurality of transport units.

12 Claims, 6 Drawing Sheets

(51) Int. Cl.
*B65D 33/16* (2006.01)
*B65D 85/04* (2006.01)

(52) U.S. Cl.
CPC .... *B65D 85/04* (2013.01); *B65D 2519/00034* (2013.01); *B65D 2519/00069* (2013.01); *B65D 2519/00268* (2013.01); *B65D 2519/00288* (2013.01); *B65D 2519/00318* (2013.01); *B65D 2519/00338* (2013.01); *B65D 2519/00407* (2013.01); *B65D 2519/0094* (2013.01); *B65D 2571/00043* (2013.01)

(58) Field of Classification Search
USPC ..... 217/43 A; 206/386, 599, 391; 108/55.1
See application file for complete search history.

(56) References Cited

U.S. PATENT DOCUMENTS 2,566,385 A * 9/1951 Van Patten ..... B65D 71/0088 206/599
2,702,682 A * 2/1955 Newsom ..... B65D 19/0028 108/51.3
2,925,978 A * 2/1960 Marso ..... B65D 19/20 108/55.1
3,061,088 A * 10/1962 Buddecke ..... B65H 55/00 242/167
3,381,817 A * 5/1968 Harm ..... B65D 75/12 229/87.01
3,638,790 A * 2/1972 Schmid ..... B65D 71/0096 206/597
3,699,901 A * 10/1972 Cook, III ..... B65D 19/004 108/57.25
3,736,885 A * 6/1973 Freund ..... B65D 19/0012 108/57.28
3,850,294 A * 11/1974 Philipps ..... B65H 71/00 242/159
3,906,591 A * 9/1975 Boiradi ..... B65D 71/02 206/83.5
3,944,070 A * 3/1976 Cardwell ..... B65D 19/004 206/596
3,976,013 A * 8/1976 Woodford ..... B65D 19/0026 248/188
4,000,704 A * 1/1977 Griffin, Jr. ..... B65D 71/0096 108/55.3
4,339,040 A * 7/1982 Peil ..... B65D 19/004 206/599
4,413,737 A * 11/1983 Wind ..... B65D 19/004 217/43 A
4,480,748 A * 11/1984 Wind ..... B65D 71/0096 108/55.3
4,500,001 A * 2/1985 Daniels ..... B65G 57/00 53/436
4,546,880 A * 10/1985 Reese ..... B65H 55/005 206/415
RE32,344 E * 2/1987 Wind ..... B65D 19/06 217/43 A
4,674,414 A * 6/1987 Nulle ..... B65D 19/004 108/901
4,765,252 A * 8/1988 Shuert ..... B65D 15/22 220/4.28
4,838,176 A * 6/1989 Bowser, Sr. ..... B65D 19/0018 108/901
4,898,321 A * 2/1990 Delany ..... B65D 19/20 206/599
5,163,554 A * 11/1992 Lampropoulos ..... B65D 85/04 53/469
5,533,456 A * 7/1996 Regina ..... B65D 19/385 211/183
5,549,056 A * 8/1996 Jordan ..... B65D 19/38 108/57.25
5,551,563 A * 9/1996 Allen ..... B65H 49/38 206/394
5,618,153 A * 4/1997 Lindgren ..... B65D 71/0096 108/53.5
5,667,065 A * 9/1997 Fahrion ..... B65D 21/0215 206/599
5,722,328 A * 3/1998 Darby ..... B65D 19/06 206/600
5,769,003 A * 6/1998 Rose ..... B65D 19/004 108/51.11
5,791,262 A * 8/1998 Knight ..... B65D 19/0012 108/57.25
5,829,592 A * 11/1998 Henry, Jr. ..... B65D 85/672 206/416
5,938,338 A * 8/1999 McDonough ..... B65D 88/1618 383/117
6,047,523 A * 4/2000 Eyre ..... B65B 11/025 53/399
6,837,377 B2 * 1/2005 Shuert ..... B65D 19/004 206/599
7,111,562 B2 * 9/2006 Nolan ..... B65D 19/0048 108/51.11
8,397,916 B1 * 3/2013 Cassidy ..... B65D 19/0028 206/386
8,602,213 B2 * 12/2013 Lowery ..... B65D 71/0096 206/386
8,960,431 B2 * 2/2015 Copp ..... B65D 85/04 229/117.22
9,676,516 B2 * 6/2017 Doll ..... B29C 51/12
9,708,085 B2 * 7/2017 Moore ..... B65B 13/02
9,926,120 B2 * 3/2018 Dapper ..... B65D 21/0205
10,093,467 B2 * 10/2018 Grennfelt ..... B65D 85/672
11,111,054 B2 * 9/2021 Wu ..... B65D 19/38
11,279,539 B2 * 3/2022 Green ..... B65D 75/006
11,667,446 B2 * 6/2023 Green ..... B65D 71/0096 206/597
11,724,865 B2 * 8/2023 Tomioka ..... B65D 85/672 206/391
11,738,927 B2 * 8/2023 Anklam ..... B65D 71/08 53/450
11,745,939 B2 * 9/2023 Brown ..... B65D 19/38 53/442
11,760,562 B2 * 9/2023 Holden ..... B65D 19/003 206/386
2001/0030142 A1 * 10/2001 Baker ..... B65D 88/1625 206/599
2003/0116460 A1 * 6/2003 Berke ..... B65D 88/1612 206/386
2004/0000498 A1 * 1/2004 Weissbrod ..... B65H 49/08 206/386
2004/0182731 A1 * 9/2004 Fuemmeler ..... B65D 19/0095 206/386
2005/0115473 A1 * 6/2005 Schutz ..... B65D 77/0466 108/55.1
2006/0081490 A1 * 4/2006 Bradford ..... B65D 71/0096 206/386
2006/0124490 A1 * 6/2006 Dufresne ..... B65D 33/2508 206/410
2007/0084741 A1 * 4/2007 Dall'Omo ..... B65D 75/52 206/391
2007/0223842 A1 * 9/2007 Sabounjian ..... D06F 95/002 220/9.2
2008/0078685 A1 * 4/2008 Patterson ..... B65D 85/07 206/391
2008/0143514 A1 * 6/2008 Valentinsson ..... B65D 19/0014 108/51.11
2008/0196304 A1 * 8/2008 Pope ..... B65D 71/0096 206/597
2008/0295748 A1 * 12/2008 Yoshida ..... B65D 19/0026 108/51.11

(56) References Cited

U.S. PATENT DOCUMENTS

2009/0020569 A1* 1/2009 Young ..... D04B 3/06 206/391
2009/0050502 A1* 2/2009 Garson ..... D04B 3/06 206/388
2009/0120823 A1* 5/2009 Seagle ..... B65D 19/0018 340/572.1
2010/0065466 A1* 3/2010 Perkins ..... B65D 77/061 220/660
2010/0224520 A1* 9/2010 Kohen ..... B65D 19/385 206/386
2011/0048994 A1* 3/2011 Eilert ..... B65D 75/5838 206/391
2011/0094979 A1* 4/2011 Lowery ..... B65D 71/0096 108/51.11
2012/0205272 A1* 8/2012 Heilman ..... B65B 25/146 206/391
2012/0261291 A1* 10/2012 Goetz ..... B65D 1/0223 206/386
2013/0213841 A1* 8/2013 Ward ..... B65D 21/0201 206/509
2014/0090998 A1* 4/2014 Kimoto ..... B65D 5/50 206/391
2014/0246347 A1* 9/2014 Burkardt ..... B65D 5/505 53/473
2014/0262861 A1* 9/2014 Crowe ..... H05B 3/36 206/216
2014/0262889 A1* 9/2014 Wahrmund ..... B65D 71/0096 206/386
2015/0239639 A1* 8/2015 Wenner ..... B65B 11/585 206/386
2015/0344174 A1* 12/2015 Hsiao ..... B65D 21/0213 206/386
2016/0107789 A1* 4/2016 Itano ..... B65D 5/32 206/386
2016/0251111 A1* 9/2016 Lewis ..... B65D 19/0018 206/386
2016/0272390 A1* 9/2016 Dapper ..... B65D 71/066
2017/0107013 A1 4/2017 Yoshifusa et al.
2018/0244430 A1* 8/2018 Berkes ..... B65D 19/0073
2019/0337695 A1* 11/2019 Kurosaki ..... B65B 17/02
2021/0053735 A1* 2/2021 Tomioka ..... B65D 79/00
2022/0135279 A1* 5/2022 Herbeck ..... B65D 19/0016 206/386
2023/0093455 A1* 3/2023 Konukoglu ..... B65D 85/04 206/386

FOREIGN PATENT DOCUMENTS

JP S4822090 U 3/1973
JP S5085539 U 7/1975
JP S6054519 U 4/1985
JP 2017074985 A 4/2017
WO 2016149170 A1 9/2016

* cited by examiner

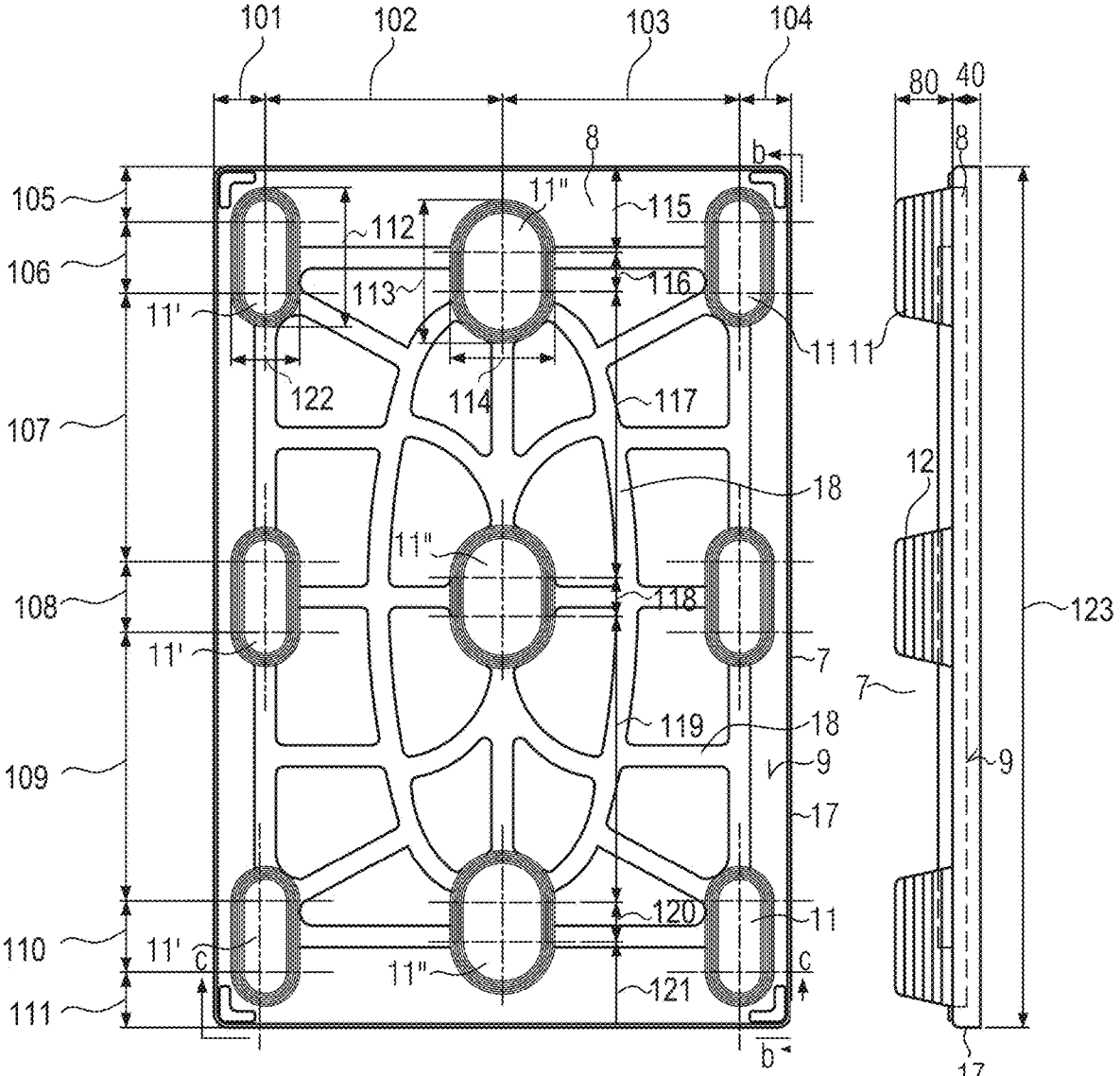
FIG. 2A
FIG. 2B
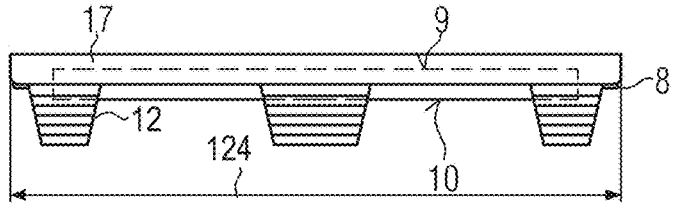
FIG. 2C

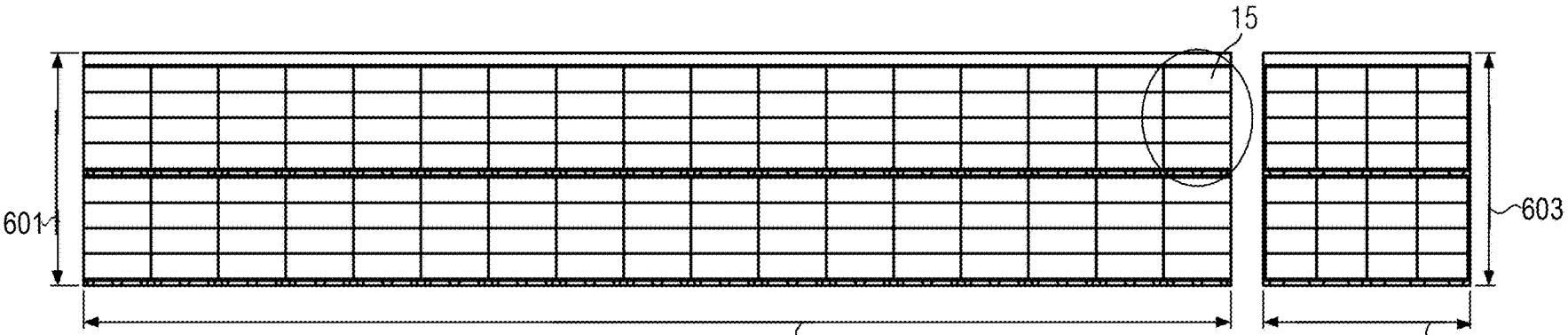
FIG. 6B
FIG. 6A
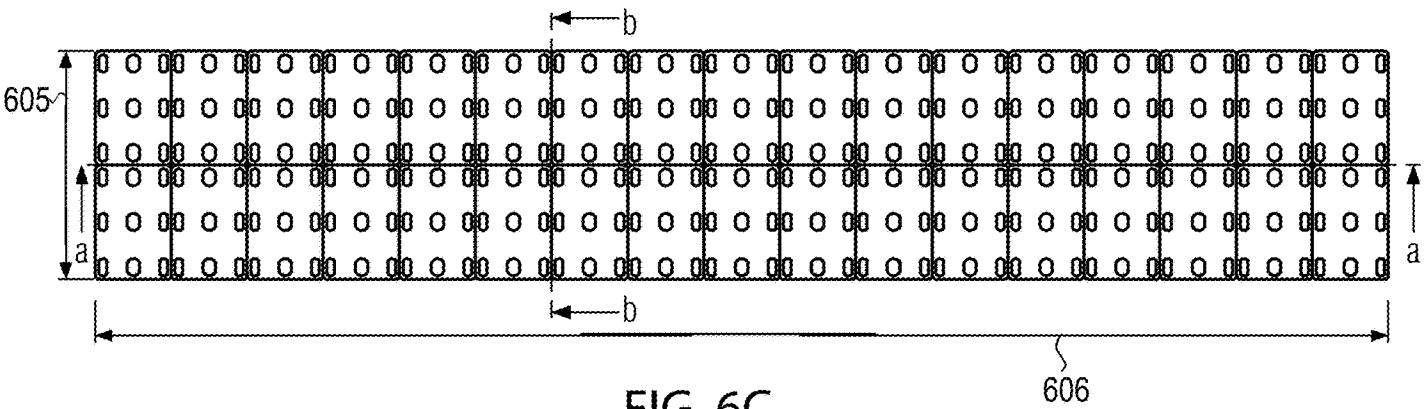
FIG. 6C

TRANSPORT UNIT FOR COILS, AND ARRANGEMENT COMPRISING THE TRANSPORT UNITS

CROSS REFERENCE TO RELATED APPLICATION

The present application is a U.S. National Phase of International Application No. PCT/EP2020/054686 entitled "TRANSPORT UNIT FOR COILS AND ASSEMBLY COMPRISING A PLURALITY OF TRANSPORT UNITS," and filed on Feb. 21, 2020. The entire contents of each of the above-listed applications are hereby incorporated by reference for all purposes.

TECHNICAL FIELD

The present invention relates to a transportation unit for transporting a plurality of coils and an assembly comprising a plurality of the inventive transport units.

BACKGROUND AND SUMMARY

The present coils are coils of yarn or filament or thread or any other material strand used in textile industries. These coils may also be called bobbins. Specifically, bobbins are also the spindles/the cores on which the material strand is wound. In the present case the term coil and bobbin are used synonymously for the coiled strand unit unlike it is otherwise indicated.

An intermediate sheet which separates several layers of coils provided on spindles/cores is disclosed in DE 35 091 09 A1. The intermediate sheet is made of a plastic material and has recesses in which the spindle/cores are held. While the spindles are fixed in the recesses the lower side surfaces of the coils are supported by supporting surfaces formed in the intermediate sheet.

A plurality of different arrangements for transporting the coils are nowadays used. However, as the coil itself is heavy and a plurality of coils are often transported together, there is a desire to provide an arrangement which is easy to handle and in which the transportation loads can be maximized.

The transportation unit comprises a pallet and a plurality of bags which are stacked in layers on the pallet. The transportation unit is for transporting a plurality of coils which are contained in this unit. Each of the bags contains a plurality of coils wherein the coils in the bag are arranged in a first layer such that the center of the coils in the first layer are arranged parallel to each other such that an axial direction of the center of each coil in the first layer is approximately perpendicular to an extension direction of the pallet. The extension direction of the pallet may correspond to the horizontal direction of the pallet, when the pallet is standing on a ground surface.

Thus the bag provides a basically inflexible subunit or a subunit having a predetermined geometry. These subunits defined by each bag are stacked on top of each other onto the pallet, for example in the direction such that the layers of the coils within the bags are parallel with respect to each.

This arrangement provides a certain self-supporting effect, while the respective bags are also easy to handle by a user.

It is beneficial that the bag holds the coils contained therein in a self-supported structure. E.g. the bag lies close against the coils inside the bag such that a stable bag assembly is provided, which holds the coils and has approximately a fixed geometry. As the coils are arranged in a flat layer wherein the peripheral surface thereof may contact each other, the respective coils can be fitted in one bag as a layer wherein the bag may provide a certain stabilization effect to fix the layered arrangement.

According to a further development between the respective adjacent layers of bags within one transportation unit which is constituted by a pallet and a plurality of bags stacked in layers, no intermediate sheet is provided. The adjacent bags stacked on top of each other on the pallet make a direct contact with each other with their exterior surfaces. As the bag which confines a plurality of coils within at least the first layer provides a self-supporting effect, it is possible that the respective adjacent layers of bags can be packed on top of each other directly contacting each other.

According to a further development, an intermediate sheet may be provided on top of a final layer of a bag or bags of the transportation unit. This intermediate sheet may serve as a support surface for a further transportation unit (pallet including a plurality of bags stacked in a layer of the pallet) which is to be placed on top of the respective transportation unit.

The bags may be stacked in layers on the pallet and that the assembly is fixed or held together by one or more fixation belts. The fixation belt may surround the respective transportation unit circumferentially in a direction approximately perpendicular to the extension direction of the pallet. The fixation belt may be wrapped around the lower side of the pallet, the respective bags arranged in layers on the pallet and if present, the intermediate sheet placed on top of the final layer of bag or bags. Two or three or more fixation belts may be provided which are arranged adjacent and parallel to each other.

According to a further development, one, more, or all bags of the transportation unit may contain at least two layers of coils wherein each layer is constituted by a plurality of coils. The center of the coils of the first layer is arranged approximately coaxially to the respective center of the coils in the second layer. Two or three or four or five or more layers of coils may be provided within one/each bag. The respective layers of coils within each bag provides a relatively inflexible structure such that a brick like configuration of the subunit formed by the bag is provided.

It is further beneficial that between the layers of the respective coils and/or within the bag no further support or separation layer is provided. That means the bag itself provides the self-supporting structure for the transportation unit.

It has been shown in a further option that more coils in the longitudinal direction of the bag compared to the transverse direction of the bag is provided in the first and/or second layer of coils within the bag. Thus, the bag including the coils defines when viewed from the top side a rectangle. The longitudinal direction of the bag has a longer length than the transversal direction of the bag. According to an example, 4 coils may be provided in the longitudinal direction in one layer of the coils and 3 coils in the transverse direction.

As a further variant, the bag has an opening on a side next to the side of the first layer and/or the second layer of coils such that the respective first and/or second layer can be fitted or be transferred into the bag from the respective opening side thereof such that the bag can be drawn over the respective layer/s of coils and can be closed at the respective side of the opening.

The bag may be closed at the end with the opening by rolling the bag end up and by roping up each of the respective corner ears of the bag in the region of the rolled up end. By doing so, a situation where the bag lies flat and is stretched to a certain extent around the exterior surface of the arrangement of the layer or layers of coils may be provided.

As alternative to the respective closing of the bag by rolling and roping the respective bag end it may be sealed by gluing or welding.

According to a further variant, the respective corner ears of the bag at which the bag is closed is adapted to be gripped by a user to remove the bag from the pallet. Therefore, when the bags are laying in the respective layers on the pallet it is beneficial that the respective opening side at which the corner ears are provided are all laying on the same side of the transport unit such that the respective bag can be easily picked up by a user.

According to a further development, in one layer of the bags on the pallet at least two rows of bags are provided wherein each row is constituted by at least one bag. Particularly two rows of bags are provided in one or each layer of bags and in each row of bags one single bag is provided. It is at least beneficial to provide more than two layers of bags wherein each layer has the same constitution. Therefore, it is beneficial to have four layers in the stacking direction of the pallet.

According to a further development, the pallet is constituted by a planar bottom. Protrusions are provided at the lower surface of the planar bottom such that cavities are constituted between the lower surface of the bottom and the surface on which the pallet is standing such that a fork of a fork lift can lift and transport the pallet from one respective location to another.

According to a further development, one or more or all the protrusions of the pallet may have an accordion like convolution such that the protrusion serving as pedestals are adapted to damp the weight of the coils stored on the pallet.

The pallet may be made of plastic material and/or may be made as a unitary body for example by injection molding.

The pallet may have such a configuration that when it is stacked without the coils with another pallet that the lower surface of the other pallet lies flush against the upper surface of the pallet and the respective protrusions of the other pallet are protruding into a backside recess of the protrusion of the pallet. This makes it possible to save space in the event that the pallets are not used for storing the coils.

The bags may be made from plastic material in particular they may be made of a woven plastic material. The bags may thus be reinforced. The bags may have a configuration that no dust or dirt or water can come into the bag and thus the coils are prevented from getting dirty or wet.

According to a further aspect, an assembly which comprises a plurality of the aforementioned transport units is also provided. The transport units may be provided in a row and at least two rows of the transport units are placed next to each other to constitute a first layer of transport units. On the first layer of transport units there may be provided a second layer of transport units having the same constitution as the first layer. This respective assembly may be provided within an interior cavity of a utility track or a shipping container. This respective assembly may also be provided on an open plate of a track.

Although in the aforementioned section it is described the transportation unit, and the assembly which comprises a plurality of the aforementioned transport units, it may also be provided a method for generating a transport unit with the aforementioned structure. E.g. coils are placed in a layer or layers in a bag, which is closed. The bag or bags are stacked in layers on the pallet. All the aforementioned features of the transport unit and the assembly may thus also be provided in a method related formulation.

BRIEF DESCRIPTION OF THE FIGURES

Further details of the invention will be explained in the following with respect to the figures. Herein:

FIGS. 3, 2A, 2B, 2C show different views of an example of a pallet;

FIG. 3 shows a stacked configuration of a plurality of pallets when they are not used to store the bags with the coils;

FIGS. 6A, 6B and 6C show the schematic view of the situation shown in FIGS. 5A and 5B.

DETAILED DESCRIPTION

In the following, the present invention is described with the help of one particular embodiment. However, the present invention is not delimited to this embodiment.

Although the respective numbers of coils in each bag, layers of coils in each bag, rows of coils in each bag, coils within one row in each bag, layers of bags on each pallet, rows of bags on each pallet, bags in each row on the pallet number of units forming one transport arrangement have a specific number in said example, the respective numbers can be in the range of ±1, ±3, ±4, ±5, ±6, etc. compared to the shown example. That e.g. means that instead of two layers of coils in each bag also one or three or four layers may be chosen. It is also not necessary that each bag contains the same number of coils and rows and layers, and that each unit contains the same number of bags and rows of bags etc. However, it is beneficial that each bag of one transportation unit has the same constitution at least in respect to the number of coils.

Figure 1A:
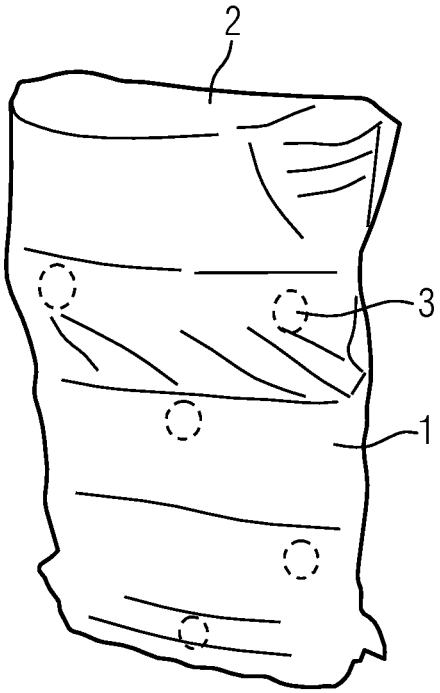
FIG. 1A shows an open bag into which two layers of coils are fitted.

FIG. 1A shows a bag 1, within which in the particular example two layers 4, 4' (e.g. FIG. 1B) of coils 3, 3' are provided. The respective bag has an opening 2 only one side opposite to the bottom side through which the complete layers 4, 4' and this particular case the first and the second layer of coils can be introduced as one coil assembly. During the insertion of the coil assembly the respective bag is stretched to a certain way onto the respective assembly of coils such that it provides a self-supporting structure.

Figure 1B:
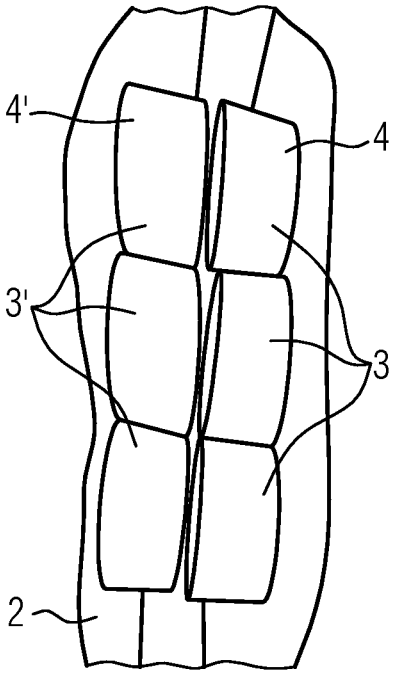
FIG. 1B shows a view into the opening provided at the end of the bag such that the two layers of coils are visible.

FIG. 1B shows a top view through the opening 2 into the bag 1. One can derive therefrom that two layers 4,4' are provided wherein each layer is constituted by three coils in the transverse direction of the bag and four coils (not visible) in the longitudinal direction of the bag.

The longitudinal direction is the direction from the bottom of the bag to the opening side of the bag.

Each coil has their center opening 5 (E.g. FIG. 4C and FIG. 4D). The respective center openings 5 of the coils within one layer of coils are parallel in respect to each other and adjacent to each other wherein the respective center openings 5 of the coils of the subsequent layer are arranged coaxially to the respective center openings 5 of the coils of the first layer. The first layer has reference sign 4 while the second layer has reference sign 4' in the present example.

The first layer is in this respective example the respective lower layer when the bag 1 is lying on the pallet 7 while the respective second layer 4' is the layer lying on the top of the first layer 4.

Within the bag 1 there is no further supporting sheet or material provided which supports the respective coils 3, 3'. The coils 3, 3' however may be each packed optionally in a separate plastic bag. The respective coils may also be contained in the bag wherein each of the coils is completely unpacked. The respective coil may have a central opening 5 in which a spindle or cylinder is contained around which the yarn is wound.

The present coils are coils of yarn or filament or thread or any other material strand used in textile industries. These coils may also be called bobbins. Specifically, bobbins are also the spindles/the cores on which the material strand is wound. In the present case the term coil and bobbin are used synonymously for the coiled strand unit unlike it is otherwise indicated.

Figure 1C:
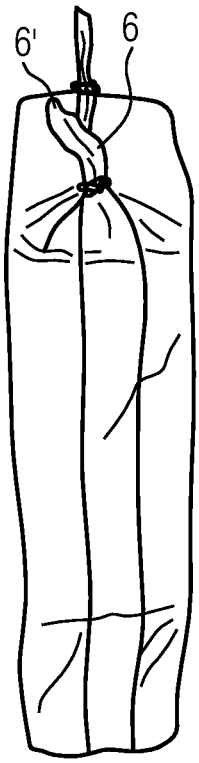
FIGS. 1C, 1D and 1E show different side views of the bag which is closed such that there are provided respective corner ears.
Figure 1D:
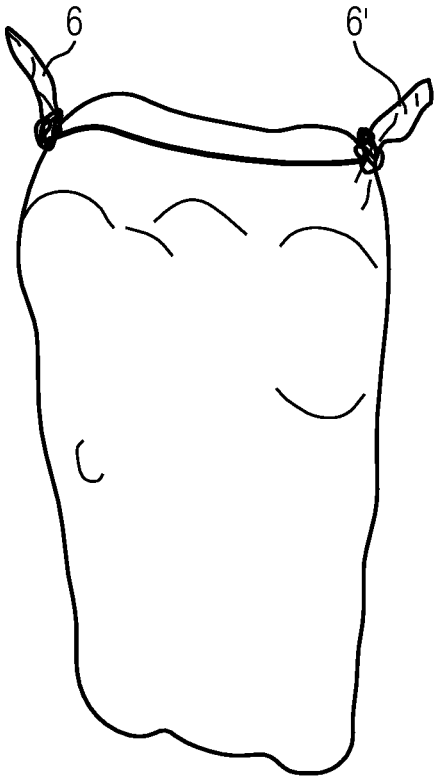
Figure 1E:
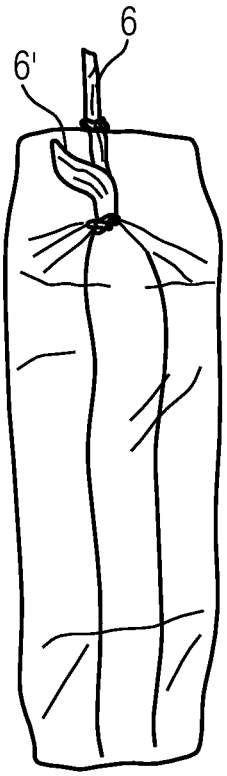

FIGS. 1C, 1D, 1E show that the respect bag 1 wherein the end of the bag at which the opening 2 has been provided has been rolled up such that the respective corner ears 6, 6' are provided.

At this corner ears 6, 6' the respective bag is knotted for being closed. This may be done by a separate element such as a cable tie like element or the respective corner ears may be knotted with their own material (not a separate element).

The pallet 7 on which the respective bags 1 are stored is shown in FIGS. 2A, 2B, 2C and FIG. 3. FIG. 2A shows a top view on top on a bottom 8 of the pallet 7. The bottom 8 has a top surface 9. Form a lower surface 10 of the bottom 8, protrusions 11 are protruding. The bottom 8 has an approximately tub shape with circumferentially erected edge walls 17, which provide a respective fixation/securing of the first layer of bags 1 provided directly on the top surface 9 of the pallet 7. The protrusions 11 may serve as pedestals such that the pallet may stand on a surface. FIG. 2B shows a cross-section across the line bb in FIG. 2A while FIG. 2C shows a cross-section along the line cc in FIG. 2A. The cross-section shown in FIG. 2C is a cross-section in the transversal direction of the pallet 7 while the respective cross-section in FIG. 2B is at cross-section along the longitudinal direction of the pallet 7. Each of the respective protrusions 11 has an accordion like convolution 12. This serves as a damping element which damps a load provided on the top surface 9 of the pallet 7. The pallet 7 may be rectangular and have the measurements shown in the table below. The measurements are given in millimeters (mm). Each of the respective dimensions can in further embodiments independently vary in the range of ±20%, ±10% of the given dimensions in said figures hence the respective dimension of the pallet can constitute an invention as such.

| Reference Number from FIG. 2A, 2B, 2C, 4A, 4B, 4C, 6A, 6B, and 6C | Dimension (millimeters) |
|---|---|
| 101 | 72 |
| 102 | 333 |
| 103 | 333 |
| 104 | 72 |
| 105 | 78 |
| 106 | 100 |
| 107 | 377 |
| 108 | 100 |
| 109 | 377 |
| 110 | 100 |
| 111 | 78 |
| 112 | 196 |
| 113 | 200 |
| 114 | 145 |
| 115 | 120 |
| 116 | 55 |
| 117 | 403 |
| 118 | 55 |
| 119 | 403 |
| 120 | 55 |
| 121 | 120 |
| 122 | 96 |
| 123 | 1210 |
| 124 | 810 |
| 401 | 800 |
| 402 | 1240 |
| 403 | 1200 |
| 404 | 1300 |
| 405 | 60 |
| 406 | 800 |
| 407 | 1200 |
| 601 | 2750 |
| 602 | 13600 |
| 603 | 2750 |
| 604 | 2450 |
| 605 | 2450 |
| 606 | 13600 |

In the present case there are nine protrusions 11 provided in total. At the longitudinal sides of the bottom 8, three oval first protrusions 11' are provided having an ovalish shape extending in the longitudinal direction of the pallet. On a line approximately in the middle of the pallet 7 in the transversal direction three oval second protrusions 11" are provided. Said second protrusions 11' have a bigger cross-sectional area (see top vie in FIG. 2A) than the first protrusions 11'.

Figure 3:
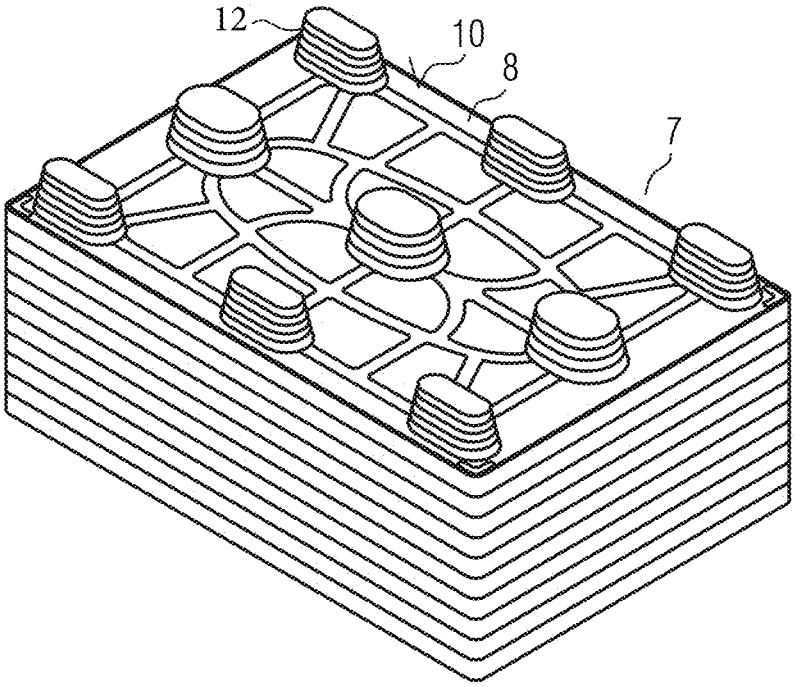

In FIG. 3 it is shown that a plurality of pallets 7 are stacked on each other when they are not loaded with certain goods. As it is shown in this figure the pallet 7 is adapted when it is stacked without the coils 3, 3' with another pallet that the lower surface of the other pallet lies flush against the upper surface of the pallet 7 wherein the respective protrusions of the other pallet are protruding unto a backside recess of the protrusion of the pallet. Due to this characteristic of the pallet it can be saved space when the pallets are not in use.

The pallet itself has some reinforcement valleys 18. As shown in FIG. 2A this reinforcement valley serves for reinforcing the plastic material of which the pallet is made. Any reinforcing feature can be provided. However, in the present case the pallet is a unitary member including the protrusion and the reinforcing valleys.

The pallet may be made of any plastic material in particular injection moldable plastic material namely.

Figure 4A:
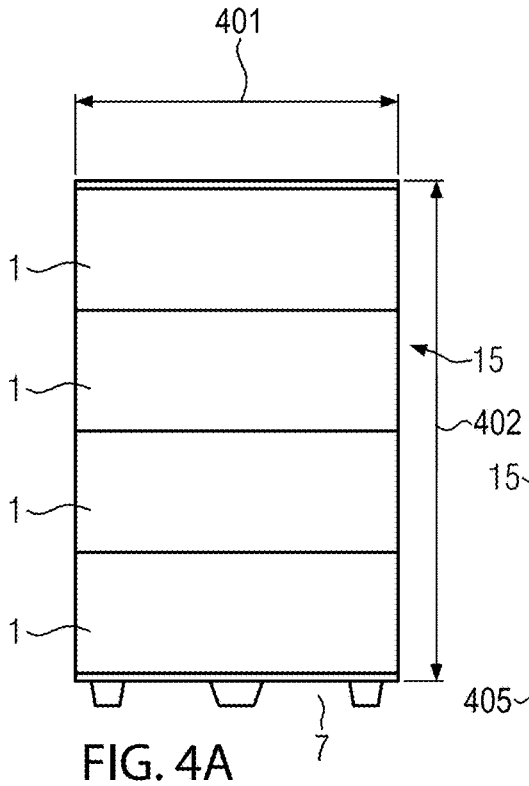
FIGS. 4A and 4B show different schematic side views on a respective transportation unit.
Figure 4B:
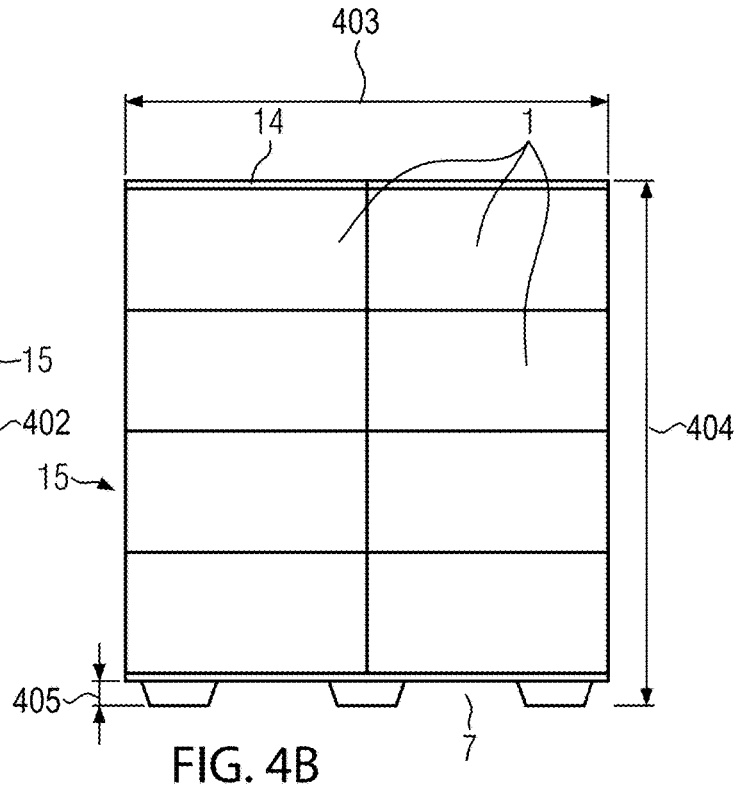
Figure 4C:
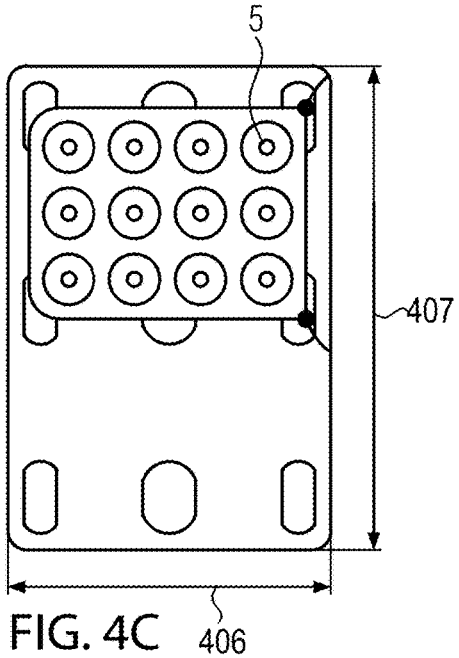
FIG. 4C shows an example wherein one bag with coils is stored on the pallet.
Figure 4D:
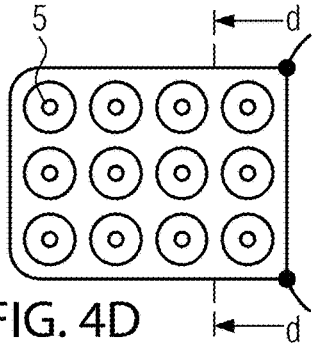
FIG. 4D shows a top view of the arrangement of the coils in the bag.

As derivable from FIGS. 4A, 4B and 4C several layers of bags 1 stacked from bottom to top are provided on each pallet 7. Namely in FIG. 4A there is shown a situation wherein the transportation unit 15 is viewed from a transversal side of the pallet 7 and thus a transversal side of the transport unit 15.

There is one bag stacked onto each other such that four layers of bags are provided.

As shown from the top view in FIG. 2C, wherein only one bag 1 is stored on the pallet. Two of such bags 1 as shown in FIG. 1A can be stored adjacent to each other such that two rows each constituted of one bag define each one of the layers of bags. In the specific example there are provided two rows of bags in the base layer, two rows of bags in the second layer, two rows of bags in the third layer and rows of bags in the fourth layer. In particular, it may be the case that the respective row in each layer of bags may have more than one bag. The respective number of layers of bags in the top-bottom direction may be higher than the respective number of rows of bags within one layer of bags.

On top of the respective assembly of the pallet 7 and the four layers of bags there is provided a further intermediate sheet 14. This intermediate sheet 14 may be made of a plastic material. The intermediate sheet 14 may serve as a supporting surface for supporting an adjacent transportation unit which is placed on top of the transportation unit shown in FIG. 4A, 4B or 4C.

Figure 4E:
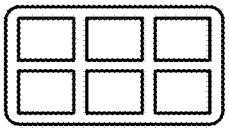
FIG. 4E shows a side view along the line dd in FIG. 4D.

FIGS. 4D and 4E show the configuration of coils 3, 3' within the bag 1. This configuration corresponds to the configuration shown in FIG. 1A to 1E. In total 24 coils are provided within one bag 1. Alternative arrangements may be the provision of any number between 12 and 48, wherein each of the respective number can serve as upper or respectively lower limit of a range of numbers which can be contained in one bag 1.

In the present case two layers of coils, wherein each layer has three coils in the transverse direction of the bag 1 and four coils in the longitudinal direction of the bag 1 are provided. Alternative arrangements may be the provision of any number of layers between 1 and 9, wherein each of the respective number can serve as upper or respectively lower limit of a range of layers which can be contained in one bag 1.

The respective side of the bag with the opening may be placed such that at least in one transportation unit the respective side are arranged next to each other, such that a user does not have to change the side at which he stand with respect to the unit, for pulling the bags 7 at their respective corner ears 6, 6'.

Figure 5A:
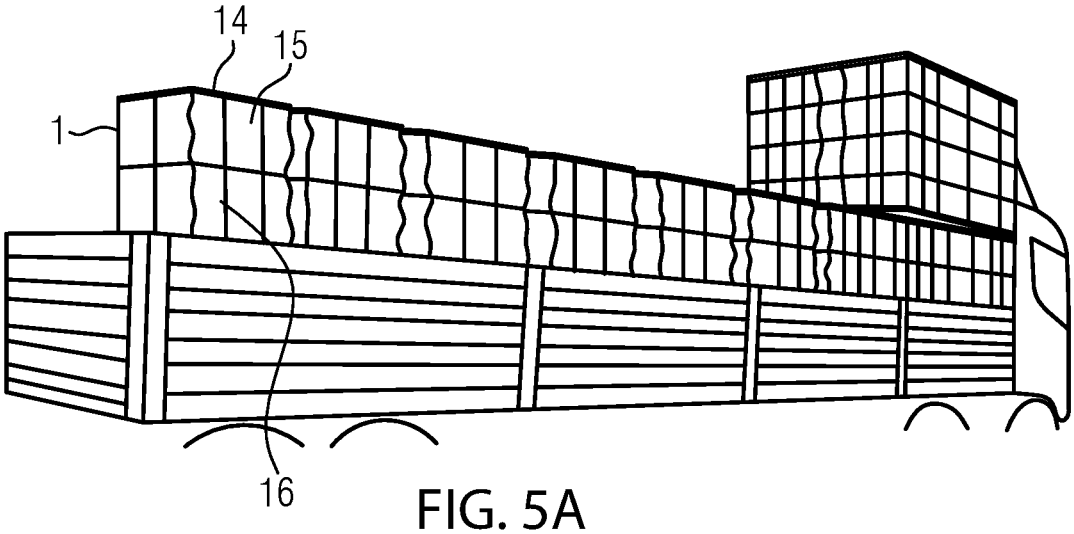
FIGS. 5A and 5B shows the situation wherein several transportation units are combined on a transporter for transporting it to a destination where the respective coils are needed.
Figure 5B:
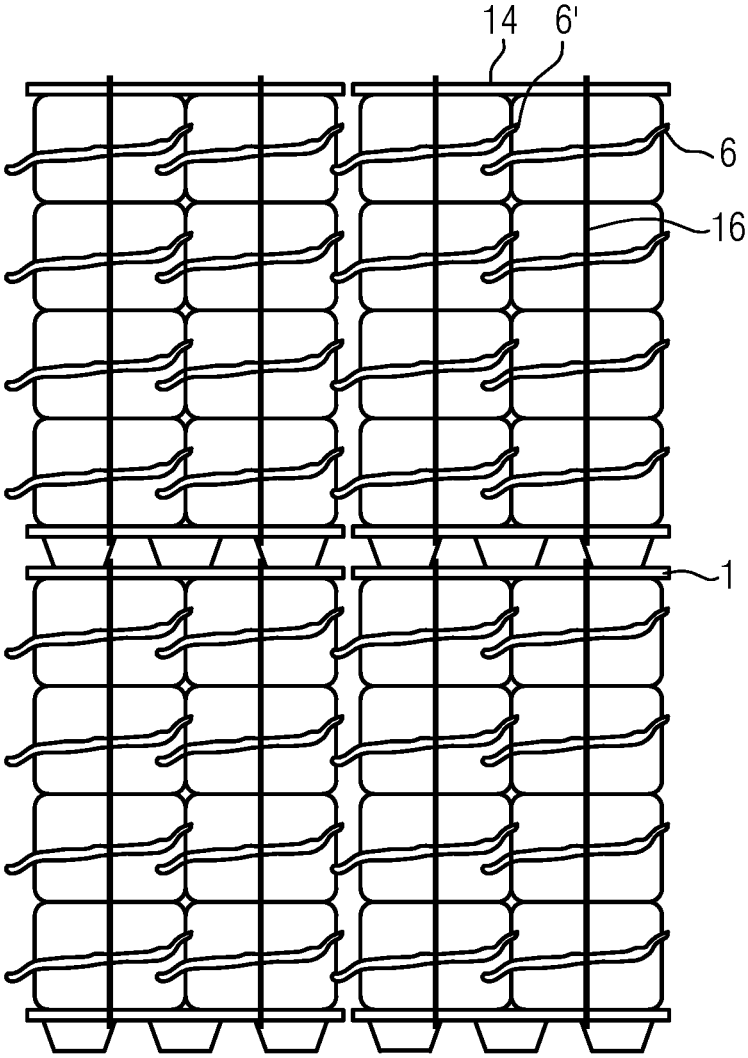

FIGS. 5A and 5B shows a situation wherein the respective transportation units 7 shown in FIGS. 4A-4E are placed on a track namely two rows of transportation units 7 are placed on the truck wherein each row on the truck contains 17 units. Two of these rows of 17 units constitutes one layer of units wherein on top of this one layer a second layer of units is provided. The lower layer of units in FIG. 5A appears to be thinner than the upper layer of units. This is due to the fact that the side wall of the truck makes the lower two layers of the bags in the units invisible.

The cross-sectional view from a rear side of the truck in FIG. 5B shows that there are provided on transportation units 7: always two transportation units 7 next to each other in the horizontal direction and two transportation units 7 on top of the two transportation units 7 next to each other.

FIGS. 6A, 6B and 6C shows a schematic sketch of the situation of FIGS. 5A and 5B.

FIG. 6A shows a cross-section along a longitudinal direction of the truck and FIG. 6B shows a top view on the pallets 7 (when the layers of bags are not visible) which define (together with the bags stored thereon the respective assembly).

FIG. 6A shows a cross-sectional view along the line aa in FIG. 6C while FIG. 6B shows a cross-sectional view along the line bb in FIG. 6C.

Although a respective specific example has been described in the foregoing, the number of elements described (coils, bags . . . ) is not essential.

Generally, the respective bag provides a self-supporting structure and it is easy to transport this arrangement. Due to the self-supporting functionality, the intermediate layers are not necessary to be provided, therefore in total a higher load of coil can be stored on the pallet and one truck can transport more coils.

Further respective pallets may be stored in a space saving manner when they are not in use. As the bags have the corner ears the respective bags can be easily taken by an operator from the respective pallet. This arrangement provides an easy transportation and an easy to handle system wherein the respective load of coils which can be shipped can be increased.

REFERENCE SIGN LIST

1 Bag
2 Opening
3, 3' Coils
4, 4' Coil layer
5 Center opening
6, 6' Corner ear
7 Pallet
8 Bottom
9 Top surface
10 Lower surface
11 Protrusions
12 Accordion like convolution
14 Intermediate sheet
15 Transportation unit
16 Fixation belt
17 Edge Walls
18 Reinforcement valley

The invention claimed is:

1. A transportation unit for transporting a plurality of coils, comprising:

a pallet; and a plurality of bags stacked in layers on the pallet, wherein each of the bags contains a plurality of coils of yarn, filament, or thread arranged in a first layer such that centers of the coils in the first layer are arranged parallel with respect to each other such that an axial direction of the center of each coil in the first layer is approximately perpendicular to an extension direction of the pallet, and wherein the extension direction is a horizontal direction of the pallet when the pallet is in use;

wherein the pallet comprises a plurality of protrusions with accordion-like convolutions extending from a bottom surface of the pallet and reinforcement valleys connecting each of the plurality of protrusions;

wherein each bag holds the coils contained therein in a self-supported structure, and wherein the bag lies close against the coils inside the bag such that a stable bag assembly defined by the bag holding the coils having approximately a fixed geometry is provided;

wherein an intermediate sheet lies on top of a final layer of a bag or bags of the transportation unit, the intermediate sheet serving as a supporting surface for a further transportation unit placed on top of the transportation unit;

wherein the bags and the pallet are fixed together by a fixation belt which surrounds the transportation unit circumferentially in a direction approximately perpendicular to the extension direction of the pallet;

wherein each bag has an opening at a side next to a side face of the first layer of coils and/or a second layer of coils;

wherein each bag is a single opening bag, and wherein the bag is configured to be closed at an end with the opening by rolling the bag end and by roping up each respective corner ear of the bag, which are obtained after the rolling up of the bag end;

wherein the respective corner ears of the bag are adapted to be gripped by a user to remove the bag from the pallet; and wherein the pallet is configured such that two bags of the plurality of bags substantially cover a top surface of the pallet, so that two bags are arranged on the pallet in each layer, wherein the two bags in each layer are arranged adjacent to each other along a transverse axis of the pallet, wherein there are provided at least more than two layers of bags in a stacking direction on the pallet, and wherein each bag of the plurality of bags has the end with the opening facing a first longitudinal edge of the pallet such that the corner ears of each bag of the plurality of bags are aligned along the longitudinal edge.

2. The transportation unit according to claim 1, wherein between adjacent layers of bags within one transportation unit no intermediate sheet is provided.

3. The transportation unit according to claim 1, wherein at least one of the bags contains at least two layers of coils, wherein each layer of the at least two layers of coils is constituted by a plurality of coils, and wherein the center of the coils of the first layer are arranged approximately coaxially to the center of the coils of a second layer of the at least two layers of coils, which is directly adjacent the first layer.

4. The transportation unit according to claim 3, wherein between the layers of the coils and/or within each bag no further support and/or separation layer is provided.

5. The transportation unit according to claim 3, wherein in the first layer and/or second layer of coils within each bag there are provided more coils in a longitudinal direction of the bag compared to a transversal direction of the bag such that the bag including the coils defines, when viewed from a top side onto the pallet, a rectangle, and wherein the longitudinal direction of the bag has a longer length than the transversal direction of the bag.

6. The transportation unit according to claim 1, wherein the pallet is constituted by a planar bottom at a lower surface of which protrusions are protruding such that there are constituted cavities, between the lower surface of the bottom and the surface on which the pallet is standing, such that a fork of a fork lift can lift and transport the pallet.

7. The transportation unit according to claim 6, wherein one or more of the protrusions have an accordion like convolution such that the protrusions serving as pedestals are adapted to damp the weight of the coils stored on the pallet.

8. The transportation unit according to claim 1, wherein the pallet is made of a plastic material.

9. The transportation unit according to claim 6, wherein the pallet is adapted that when it is stacked without the coils with another pallet that the lower surface of the other pallet lies flush against the upper surface of the pallet the respective protrusions of the other pallet are protruding into a backside recess of the protrusion of the pallet.

10. The transportation unit according to claim 1, wherein the bags are made of plastic material.

11. An assembly comprising a plurality of transport units according to claim 1, wherein the transport units are provided in a row, and at least two rows of transport units are placed adjacent to each other in a horizontal direction such that a first layer of transport units is constituted, and wherein on the first layer of transport units at least a second layer of transport units having the same constitution as the first layer transport units is placed.

12. The transportation unit according to claim 1, wherein the plurality of protrusions comprises nine oval-shaped protrusions, wherein a first set of protrusions of the plurality of protrusions are uniformly sized and positioned along longitudinal edges of the pallet, wherein a second set of protrusions of the plurality of protrusions are positioned in a central area between the longitudinal edges, wherein each protrusion of the second set of protrusions has a bigger cross-sectional area than each protrusion of the first set of protrusions, and wherein the plurality of protrusions and the reinforcement valleys are formed as a unitary member.

* * * * *